United States Patent [19]

McCarty

[11] 4,158,950

[45] Jun. 26, 1979

[54] HEAT PUMP DEFROST SYSTEM

[75] Inventor: William J. McCarty, Louisville, Ky.

[73] Assignee: General Electric Company, Louisville, Ky.

[21] Appl. No.: 878,347

[22] Filed: Feb. 16, 1978

[51] Int. Cl.[2] ..... F25D 21/06

[52] U.S. Cl. ..... 62/278; 62/81; 62/324

[58] Field of Search ..... 62/278, 81, 196 C, 117, 62/196 R, 324 A, 324 R, 151

[56] References Cited

U.S. PATENT DOCUMENTS

| | | | |
|---|---|---|---|
| 3,159,981 | 12/1964 | Huskey | 62/140 X |
| 3,370,437 | 2/1968 | Jacobs | 62/160 |
| 3,511,060 | 5/1970 | Bodcher | 62/278 X |
| 3,558,842 | 1/1971 | Bodcher | 62/278 X |
| 3,871,187 | 3/1975 | Skvarenina | 62/278 X |
| 4,027,497 | 6/1977 | Thurman | 62/275 X |

*Primary Examiner*—William E. Wayner

*Attorney, Agent, or Firm*—Frank P. Giacalone; Radford M. Reams

[57] ABSTRACT

The present invention relates to a defrost arrangement for refrigeration systems and in the preferred embodiment to reverse cycle, heat pump refrigeration systems. A secondary defrost circuit is provided including valves which permit refrigerant flow to by-pass the compressor and the expansion device only when compressor operation terminates and the system pressure differential is equalized. The refrigerant flow in the secondary circuits allows refrigerant to flow between the upper portions and lower portions of the indoor and outdoor heat exchangers. This free non-restrictive flow of refrigerant causes the relatively warm refrigerant in gaseous phase when present in the condenser to displace the relatively cold refrigerant in liquid phase when present in the evaporator, with the flow continuing until the system equalizes.

5 Claims, 1 Drawing Figure

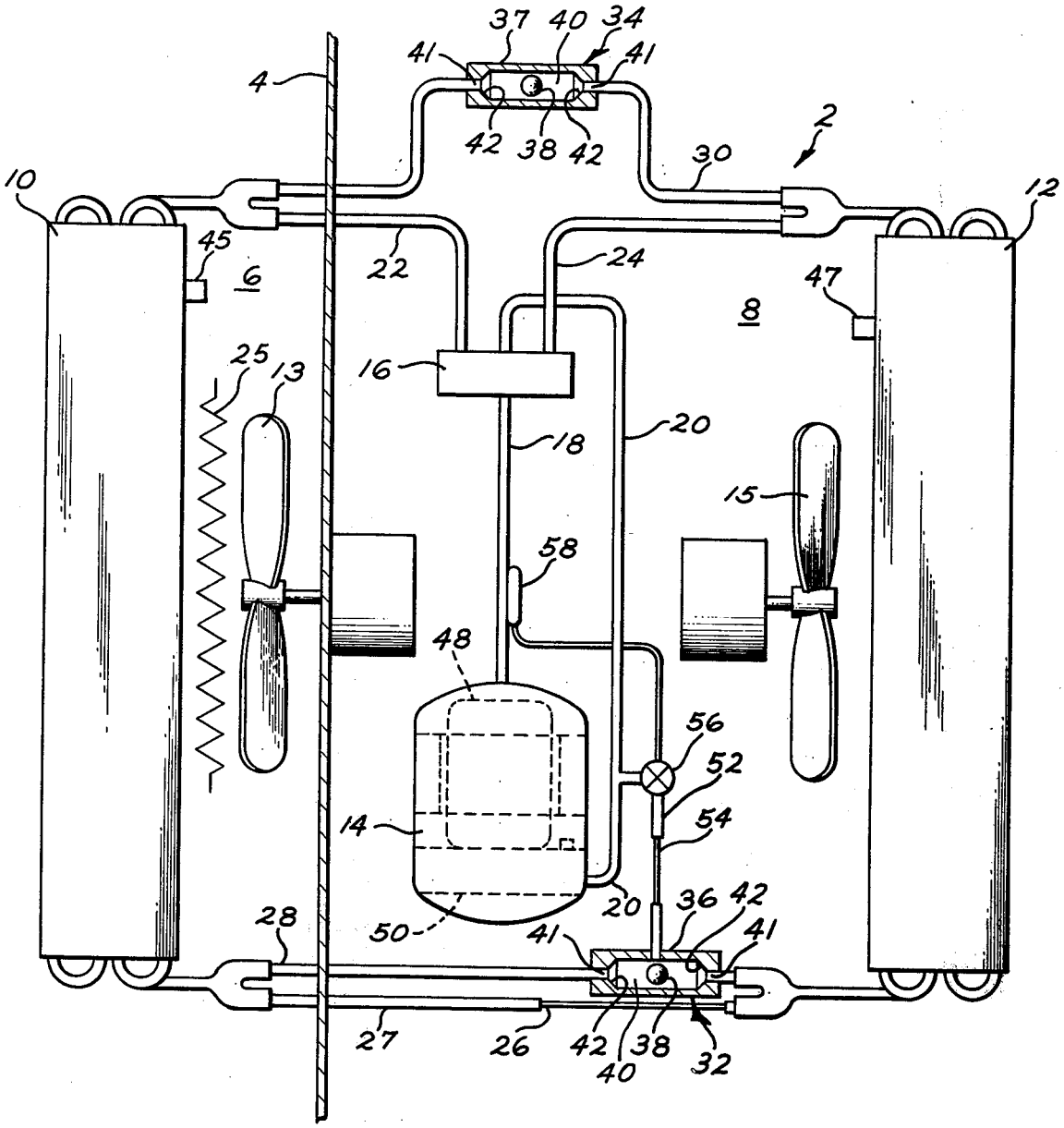
37
40
34
41
41
4
42
38
42
2
30
10
12
45
6
22
24
47
8
25
13
16
20
18
15
58
48
56
52
54
14
20
36
42
28
50
41
41
27
26
42
38
40
32

HEAT PUMP DEFROST SYSTEM

BACKGROUND OF THE INVENTION

Generally, self-contained air conditioning units of the reversible type which are adapted to be mounted in the outer wall of an enclosure and utilized for heating the air from the enclosure during the winter and cooling the air from the enclosure during the summer comprise a housing divided into an indoor section and an outdoor section. An indoor heat exchanger is disposed in the indoor section while an outdoor heat exchanger is disposed in the outdoor section and usually the compressor including the reversing valve are located in the outdoor section.

The compressor is reversibly connected to the heat exchangers through the reversing valve so that the indoor heat exchanger functions as an evaporator when the unit is operating on the cooling cycle and the outdoor heat exchanger functions as the evaporator on the heating cycle. Suitable independent fan means may be provided for circulating indoor air over the indoor heat exchanger and outdoor air over the outdoor heat exchanger during operation of the system on either the heating or cooling cycle.

Under certain operating conditions in the heating cycle, the outdoor heat exchanger functioning as the evaporator may operate at such low outdoor ambient temperatures as to cause the accumulation of a coating or layer of frost on its surface. Since frost when it accumulates operates as a barrier to heat transfer between the evaporator and the air being circulated thereover, the efficiency of the unit is markedly reduced. Further, unless means are provided for interrupting the accumulation of frost, the evaporator can become completely filled with a layer of frost that may effectively block air passage therethrough. This blockage of air results in the loss of heat exchange and if allowed to continue can cause refrigeration system components to fail and can also result in compressor burn-out unless compressor operation is terminated.

The shutting down of compressor operation each time frost accumulates severely curtails the operation of the unit in the heating cycle and accordingly the efficiency of the unit as a heating means at temperatures below the evaporator frosting level.

In some prior art applications such as U.S. Pat. No. 3,159,981—Huskey, assigned to the General Electric Company, assignee of the present invention, a control circuit is utilized to interrupt the operation of the compressor whenever either the outdoor or indoor heat exchanger attains a frosting temperature and further to supply auxiliary heat to the enclosure whenever the operation of the compressor is interrupted during the heating cycle.

In other prior art systems, the refrigeration system is reversed so that the outdoor coil that accumulates frost when it operates as an evaporator functions as a condenser long enough to melt accumulated frost.

In U.S. Pat. No. 3,555,842—Bodcher, a defrost line connects the upper inlet of the condenser to the upper inlet of the evaporator and includes a defrost valve which is closed during operation of the compressor but opens when compressor operation terminates. A return line connects the evaporator collector with the lower part of the condenser and includes a valve which operates in the same manner as the defrost valve.

SUMMARY OF THE INVENTION

In the preferred embodiment, the present invention relates to a self-contained air conditioning unit for heating and cooling an enclosure. The refrigeration system includes a compressor, condenser, evaporator and a flow control means arranged between the condenser and evaporator.

The compressor's high pressure outlet port is connected in fluid communication with the inlet port of the condenser. The condenser high pressure liquid refrigerant outlet port is connected by a refrigerant line in fluid communication with the evaporator inlet port. The evaporator low pressure gas outlet port is connected in fluid communication with the inlet port of the compressor. The flow control means is arranged in the refrigerant line intermediate the condenser outlet port and evaporator inlet port.

A first flow passage is connected between the low pressure outlet of the evaporator and the high pressure inlet of the condenser being parallel to the compressor to form a by-pass flow.

A second flow passage is connected between the high pressure outlet of the condenser and the low pressure inlet of the evaporator being parallel to the flow control means to form a by-pass flow.

A first valve in the first flow passage is operable for holding the valve in a closed position when a pressure differential is present between the evaporator and condenser and for allowing residual refrigerant to by-pass the compressor and flow through the first flow passage when compressor operation terminates and said pressure differential is equalized.

A second valve in the second flow passage is operable for holding the valve in a closed position when a pressure differential is present between the condenser and evaporator and for allowing residual refrigerant to by-pass the flow control means and flow through the second flow passage after compressor operation terminates and said pressure differential is equalized.

Accordingly, when compressor operation terminates, the pressure differential in the system bleeds down through the flow control means and residual refrigerant will flow in a closed circuit, through said first and second flow passages, by-passing the compressor and the flow control means.

DESCRIPTION OF THE DRAWING

FIG. 1 is a diagrammatic illustration of a reverse cycle refrigeration system incorporating the present invention.

DESCRIPTION OF THE PREFERRED EMBODIMENTS

In accordance with the defrost system of the present invention, the refrigeration system to which it is applied in the preferred instance is a heating and cooling system more commonly referred to as a heat pump.

Referring now to the drawings, there is shown a heat pump or reversible refrigeration unit 2 divided by a barrier 4 into an indoor section 6 and an outdoor section 8. The unit 2 is adapted to be mounted within an opening in a wall (not shown) in a manner that the indoor section 6 communicates with air to be conditioned in a room or other enclosure, while the outdoor section 8 communicates with outdoor air, i.e., air outside the enclosure to be conditioned. The refrigeration system comprises an indoor heat exchanger 10 arranged in the indoor section 6 and an outdoor heat exchanger 12 arranged in the outdoor section 8. The indoor heat exchanger 10, as will be explained hereinafter, is arranged for heating or cooling an enclosure. Enclosure air to be conditioned is drawn into the indoor section by fan 13 and directed through the heat exchanger 10 and passed back into the enclosure. Outdoor air is drawn into the outdoor section 8 and circulated through heat exchanger 12 and returned outdoors by a fan 15.

The two heat exchangers 10 and 12 form part of a closed refrigerant circuit including means for withdrawing refrigerant from either one of the two exchangers and discharging compressed refrigerant into the other, such means comprising a compressor 14 and reversing valve 16 which are usually located in the outdoor section 8.

The reversing valve 16 is designed to reversibly connect the discharge line 18 and the suction line 20 of the compressor to the remaining portion of the system so that the compressor will withdraw low pressure refrigerant from either the indoor or the outdoor heat exchanger and discharge compressed high pressure refrigerant into the other of the two heat exchangers. Thus, the outdoor heat exchanger 12 functions as an evaporator and the indoor heat exchanger 10 as a condenser when the system is operated on the heating mode or cycle.

As shown in the drawing, the discharge line 18 and suction line 20 are both connected to the reversing valve 16. Also connected to the reversing valve 16 are a pair of conduits 22 and 24 which lead respectively to the indoor and outdoor heat exchangers 10 and 12. Included in the system for the purpose of expanding refrigerant from condensing pressure to evaporator pressure is a capillary expansion means 26 connected in the systems liquid line 27. This capillary 26 operates as an expansion means during both cooling and heating cycles and maintains a predetermined pressure differential between the evaporator and the condenser regardless of the direction of refrigerant flow.

As mentioned hereinbefore, in an air conditioning unit of this type, the indoor coil 10 is arranged for heating or cooling air from an enclosure, while the outdoor coil 12 is arranged for either rejecting heat to or extracting heat from the outside atmosphere. The reversing valve 16 is selectively reversible to direct discharge gas into either one of the lines 22, 24 while receiving low pressure gas from the other line, thereby making the system reversible for either heating or cooling an enclosure. Thus, if it is desirable to set this system on the heating cycle, compressor discharge gas flowing through the discharge line 18 is connected by means of the reversing valve 16 to the line 22 which carries the hot discharge gas to the indoor coil 10. This coil then acts as the condenser to give up its heat to the enclosure. If it is desired to set the system for cooling the enclosure, the suction line 20 is connected to the indoor coil through line 22 which then acts as an evaporator, while the discharge gas is carried to the outdoor coil by the line 24.

In the event the heat output of the refrigeration system in the heating mode is not sufficient to maintain the enclosure temperature at a preferred level, an auxiliary heater 25 may be provided to supplement the heat output of the system. During times when compressor operation is interrupted, heater 25 may be energized together with indoor fan 13. The heat generated by the heater 25 will under normal operating conditions be sufficient to maintain the enclosure ambient at its preselected temperature.

In the course of the refrigerating cycle operating in the heating mode, water vapor under certain ambient conditions condenses on the outdoor heat exchanger which is functioning as the evaporator. In some instances the amount of water vapor available in the outdoor ambient is great enough to solidify and form a layer of ice which blocks air flow through the heat exchanger. This layer of ice must be removed when it has a thickness which opposes the desirable transfer of heat from the heat exchanger. Accordingly, by the present invention means are provided that permit defrosting and the elimination of frost when present on the evaporator each time the operation of the system compressor terminates. Under certain operating conditions, the outdoor heat exchanger 12 functioning as the evaporator may operate at such low outdoor ambient temperatures as to cause the accumulation of frost thereon to be accelerated. In its preferred application the present embodiment of the defrost system is intended to be used in defrosting the outdoor heat exchanger in a manner that will not completely interrupt the heating process of the enclosure air. It should be understood however that the present defrost arrangement permits defrosting of the heat exchanger that is operating as an evaporator in either the cooling or heating mode.

The means for effecting the defrosting of the evaporator as shown in the drawing includes a by-pass line or conduit 28 which is connected between the lower portions of the indoor and outdoor heat exchangers 10 and 12. In effect, the by-pass line 28 is arranged parallel to the refrigerant flow through expansion capillary 26 and line 27. A second by-pass line or conduit 30 is connected between the upper portion of the indoor and outdoor heat exchangers 10 and 12. Line 30 is arranged parallel to lines 22, 24 and reversing valve 16. In effect, a circuit through line 30 will by-pass both valve 16 and compressor 14. The defrost circuit provided by the present invention is through a closed loop provided by conduits 28, 30 and heat exchangers 10 and 12 with the compressor 14 and capillary 26 being by-passed.

Means are also provided to prevent refrigerant flow through either conduit 28 or 30 when the compressor 14 is circulating refrigerant during normal operation of the refrigerating system in either the heating or cooling mode. To this end, valves 32 and 34 are provided respectively in the conduits 28 and 30.

As will be explained in detail hereinafter, the valves 32 and 34 are designed to close when a pressure differential is present in the system. Since this pressure differential is created by compressor operation, valves 32 and 34 will remain closed when the system is operating in either the heating or cooling mode. Accordingly, the added by-pass conduits 28, 30 and their respective valves 32 and 34 have no effect on the system during its normal operation in either the heating or cooling mode. Further, the valves are designed to remain closed until after the compressor operation terminates and the system pressure differential created by the operating compressor is bled down through the normal system capillary 26. At this point, valves 32 and 34 will open and the defrost circuit established.

While the exact construction of the valves 32 and 34 is not critical in carrying out the defrosting of the evaporator, schematic ball valves have been illustrated. It should be noted that other type valves may be employed and accordingly the valves as shown are not critical in carrying out the present invention. The valves 32 and 34 are identical in the present embodiment with each valve including a body member 36, 37, connected in lines 28 and 30 respectively intermediate the inlet and outlet of the condenser and evaporator. Referring to body member 37 of valve 34, there is provided a valve chamber 40 having openings 41 at each end thereof communicating with lines 30. Arranged adjacent each opening 41 are valve seats 42. A ball valve 38 is arranged for free movement in the valve chamber 40. The ball valve 38 is allowed to move between valve seats 42 under influence of refrigerant flow under pressure so as to prevent refrigerant flow through the valve 34 when the compressor 14 is operating.

Valve 32 as stated above is identical to valve 34 and includes a chamber 40 openings 41 at each end thereof communicating with line 28 and valve seats 42 adjacent each opening 41 for cooperatively receiving ball valve 38.

Accordingly, the flow of refrigerant when present in either direction creating a pressure differential during compressor operation will cause the ball valve 38 to be driven by the forced flow of refrigerant to engage a valve seat 42 and accordingly prevent flow through the conduits 28 and 30. The valves 32 and 34 will, as explained hereinafter, remain in their closed position under influence of refrigerant flow forced through the system by the compressor so that the system as explained hereinabove will operate in its normal manner in either the heating or cooling mode. Termination of the compressor operation is effected by either the enclosure ambient temperature being at a selected comfort level or by the frost sensing controls 45, 47 arranged to detect frost accumulation on the heat exchangers 10 and 12 respectively.

In operation, with the unit in the heating mode and a frost condition sensed by control 47 relative to the outdoor heat exchanger 12 functioning as the evaporator, compressor operation terminates. At this time, as mentioned hereinbefore, with the compressor 14 not operating the system pressure differential will bleed down through the system capillary 26. The valves are so designed that the ball valve member 38 will fall away from its seat 42 when the pressure differentials are bled to zero. Accordingly, the ball valve members 38 in the valves 32 and 34 being no longer under the influence of the pumped refrigerant flow under pressure fall into the neutral or open position shown in the drawing and away from the valve seats 42 and a non-restricted defrost flow path through conduit 28 and 30 between the lower and upper portions of the heat exchanger is established. With the valves 32 and 34 in their neutral or open position, and frost present on heat exchanger 12, the relatively hot gaseous phase of refrigerant fluid will flow from the upper portion of the condenser or indoor heat exchanger 10 through line 30, open valve 34 and into the upper portion of the frosted evaporator or outdoor heat exchanger 12. The liquid refrigerant in the lower portion of the evaporator or outdoor heat exchanger 12, which is relatively cool, flows through line 28, open valve 32, into the lower portion of the warmer condenser or indoor heat exchanger 10 where it is heated and returns to gaseous phase. The liquid refrigerant accumulated in the frosted heat exchanger will drain to the heat exchanger containing gas due to a gravity head created by the accumulated liquid height. The cold liquid at approximately 32° F. in the frosted heat exchanger will absorb heat from the warm heat exchanger and will change to gas. As liquid drains from the bottom of the frosted heat exchanger, warm gas will enter the top of the frosted coil through conduit 30. This flow of cold liquid out of the bottom of the frosted heat exchanger through conduit 28 to the warm heat exchanger and the flow of warm gas out of the top of the warm heat exchanger through conduit 30 to the cold heat exchanger produces an effective defrosting cycle that will continue until the temperature of the defrosted heat exchanger approaches the temperature of the warm heat exchanger. At this point, gravity flow will terminate because liquid can accumulate in both heat exchangers.

Heat added to the refrigerant during the defrosting cycles comes from the warm or non-frosted coil which will be in a relatively warm ambient. By the present invention the auxiliary heater 25 and fan 13 can be employed to provide warm air flow through the warm heat exchanger.

While the heater 25 and fan 13 may be energized to provide auxiliary heat during peak demands, it also provides heat to the enclosure during the defrosting operation. The heater function during the defrosting or compressor-off period is effective in maintaining the temperature of the condenser 10 substantially above the enclosure ambient and in fact elevated enough to ensure that the liquid refrigerant entering the bottom portion of heat exchanger 10 through valve 32 is returned to gaseous phase.

As can be easily understood, the circulation of relatively warm refrigerant fluid in gaseous phase from the condenser 10 into the relatively cold frost-laden evaporator 12 and the simultaneous extraction of the colder refrigerant fluid in liquid phase from the lower portion of the evaporator 10 produces a heat transfer which provides for evaporator defrosting. This free flowing circulation of refrigerant past the system capillary and compressor continues until the pressure and temperature in the system equalize. A complete secondary refrigerant flow circuit including the compressor reversing valve by-pass lines 30, the capillary by-pass line 28 and the indoor and outdoor heat exchangers in a series-closed circuit provides an effective defrost arrangement.

It should be understood that the defrost cycle will be effective in either the heating mode as explained hereinabove or in the cooling mode since the defrost flow will always be between the cold and warm heat exchangers through the two-way valves. However, the valve could be designed for one-way flow and the system be designed to function only in the heating mode.

In order to assure that the temperature of the discharge gas is sufficiently low to properly cool the compressor motor 48 as the gas is circulated thereover after it leaves the compressor chamber 50, there may be provided means for injecting a metered quantity of liquid refrigerant into the suction line 20. In the illustrated embodiment of the invention, liquid refrigerant leaving the heat exchanger operating as the condenser enters chamber 40 of valve 32. From chamber 40 the liquid refrigerant passes through a liquid line 52 and is inserted into suction line 20 from which it is carried into the compressor chamber 50. A restrictor 54 in line 52 limits flow through the liquid line 52 while preventing short circuiting of the evaporator. Means are also provided to control the flow of liquid refrigerant through line 52 depending on the temperature or pressure of the gas flow in the discharge line 18. Accordingly, a valve 56 is arranged in liquid line 52 and controlled by a sensing means 58 positioned on discharge line 18.

What is claimed is:

1. A heat pump system for heating and cooling an enclosure of the type having a refrigerant capable of boiling under relatively low pressure to absorb heat and condensing under relatively high pressure to expel heat, including a defrost circuit which comprises:

first and second heat exchangers having upper and lower portions;

a compressor for compressing a refrigerant fluid in gaseous phase having a high pressure outlet port and a low pressure inlet port;

a reversing valve for selectively connecting said compressor to said heat exchangers whereby said first heat exchanger functions as a condenser in the heating cycle and said second heat exchanger functions as the condenser in the cooling cycle;

said first heat exchanger when functioning as a condenser having a high pressure inlet port and a high pressure liquid refrigerant outlet port, means connecting said inlet port to said compressor outlet;

said second heat exchanger when functioning as an evaporator having a low pressure liquid inlet port in fluid communication with said high pressure liquid refrigerant outlet port of said condenser by a fluid line, and having a low pressure outlet port at its upper portion, means connecting said outlet port with said inlet port of said compressor;

a flow control means in said fluid line;

a first defrost flow passage connected between said low pressure outlet port of said second heat exchanger and said high pressure inlet port of said first heat exchanger;

a second defrost flow passage connected between said high pressure outlet of said first heat exchanger and said low pressure inlet of said second heat exchanger;

a first valve in said first flow passage;

a second valve in said second flow passage;

valve means in said first and second valves operable for holding said valves in their closed position when a refrigerant pressure differential is present in said system and being operable to an open position when said pressure differential is bled down through said flow control means after said compressor operation terminates, so that a non-restrictive refrigerant defrost flow path circuit is established through said first flow passage between the upper portions of said heat exchangers and through said second flow passage between the lower portions of said heat exchangers thereby allowing liquid refrigerant when present in the lower portion of said heat exchanger to flow through said second flow passage into the lower portion of said first heat exchanger while warmer gaseous refrigerant when present in the upper portion of said first heat exchanger will flow through said first flow passage into the upper portion of said second heat exchanger.

2. The heat pump system as claimed in claim 1 wherein said high pressure inlet port is arranged in the upper portion of said first heat exchanger and said second heat exchanger outlet port is arranged in its upper portion, and said high pressure liquid refrigerant outlet port is arranged in the lower portion of said first heat exchanger and said second heat exchanger having its low pressure liquid inlet port arranged in its lower portion.

3. The heat pump system as claimed in claim 1 wherein said inlet port of said first heat exchanger is connected through said reversing valve to said compressor outlet for receiving high pressure refrigerant in gaseous phase from said compressor and said low pressure outlet port of said second heat exchanger is connected through said reversing valve to said compressor inlet for directing low pressure refrigerant in gaseous phase to said compressor.

4. The heat pump system as claimed in claim 3 wherein said first defrost flow passage is parallel to said compressor and said reversing valve and said second defrost flow passage is parallel to said liquid line.

5. A heat pump system for heating and cooling an enclosure of the type having a refrigerant capable of boiling under relatively low pressure to absorb heat and for condensing under relatively high pressure to expel heat, including a defrost circuit which comprises:

first and second heat exchangers having upper and lower portions;

a compressor for compressing a refrigerant fluid in gaseous phase having a high pressure outlet port and a low pressure inlet port;

a reversing valve for selectively connecting said compressor to said heat exchangers whereby said first heat exchanger functions as a condenser in the heating cycle and said second heat exchanger functions as the condenser in the cooling cycle;

said first heat exchanger having a high pressure inlet port at its upper portion and a high pressure liquid refrigerant outlet port at its low portion, means connecting said inlet port through said reversing valve to said compressor outlet for receiving high pressure refrigerant in gaseous phase;

said second heat exchanger having a low pressure liquid inlet port at its lower portion in fluid communication with said high pressure liquid refrigerant outlet port of said condenser by a fluid line, and having a low pressure outlet port at its upper portion, means connecting said outlet through said reversing valve with said inlet port of said compressor for receiving low pressure refrigerant in gaseous phase;

a flow control means connected in the fluid line between the high pressure outlet port of said first heat exchanger and the low pressure inlet port of said second heat exchanger;

a first defrost flow passage parallel to said compressor and said reversing valve being connected between said low pressure outlet port of said second heat exchanger and said high pressure inlet port of said first heat exchanger;

a second defrost flow passage parallel to said flow control means in said liquid line being connected between said high pressure outlet of said first heat exchanger and said low pressure inlet of said second heat exchanger;

a first valve in said first flow passage;

a second valve in said second flow passage;

valve means in said first and second valves operable for holding said valves in their closed position when a refrigerant pressure differential is present in said system and being operable to an open position when said pressure differential is bled down through said flow control means after said compressor operation terminates, so that a non-restrictive defrost flow path circuit is established through said first flow passage between the upper portions of said heat exchangers and through said second flow passage between the lower portions of said heat exchangers thereby allowing liquid refrigerant when present in the lower portion of said second heat exchanger to flow through said second flow passage into the lower portion of said first heat exchanger while warmer gaseous refrigerant when present in the upper portion of said first heat exchanger will flow through said first flow passage into the upper portion of said second heat exchanger.

* * * * *